US007111654B2

(12) United States Patent
Takagi

(10) Patent No.: US 7,111,654 B2
(45) **Date of Patent: *Sep. 26, 2006**

(54) DEVELOPER SUPPLY CONTAINER

(75) Inventor: Masafumi Takagi, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/203,117
(22) Filed: Aug. 15, 2005

(65) Prior Publication Data

US 2006/0000520 A1 Jan. 5, 2006

Related U.S. Application Data

(62) Division of application No. 10/665,604, filed on Sep. 22, 2003, now Pat. No. 6,971,421.

(30) Foreign Application Priority Data

Sep. 25, 2002 (JP) ..... 2002-278911
Aug. 25, 2003 (JP) ..... 2003-299708

(51) Int. Cl.
*B65B 1/04* (2006.01)

(52) U.S. Cl. ..... 141/351; 141/301

(58) Field of Classification Search ..... 141/351, 141/301, 302, 218, 98; 222/DIG. 1; 399/111–114; 251/212

See application file for complete search history.

(56) References Cited

U.S. PATENT DOCUMENTS

| | | | | |
|---|---|---|---|---|
| 149,430 | A | 4/1874 | Bowen | |
| 4,844,292 | A | 7/1989 | Lonardi et al. | 222/503 |
| 5,109,254 | A | 4/1992 | Oka et al. | 355/200 |
| 5,548,384 | A | 8/1996 | Weed | 355/260 |
| 5,564,607 | A | 10/1996 | Miller et al. | 222/325 |
| 5,970,292 | A | 10/1999 | Miller | 399/262 |
| 6,438,345 | B1 | 8/2002 | Ban et al. | 399/262 |

FOREIGN PATENT DOCUMENTS

JP 2000-347493 12/2000

*Primary Examiner*—Steven O. Douglas
(74) *Attorney, Agent, or Firm*—Fitzpatrick, Cella, Harper & Scinto

(57) ABSTRACT

A developer supply container detachably mountable to an image forming apparatus, includes a container body for containing a developer; a discharge opening for permitting discharge of the developer from the container body; shutter means for unsealing and sealing the discharge opening; wherein the shutter means has a first shutter member and a second shutter member resealably provided at a position facing to the discharge opening.

15 Claims, 8 Drawing Sheets

DEVELOPER SUPPLY CONTAINER

CROSS-REFERENCE TO RELATED APPLICATION

This application is a divisional of application Ser. No. 10/665,604, filed Sep. 22, 2003 now U.S. Pat. No. 6,971, 421.

FIELD OF THE INVENTION AND RELATED ART

The present invention relates to a developer supply container for supplying the developer. More particularly, it relates to a developer supply container for supplying the developer into an image forming apparatus such as a copying machine, printer, facsimile machine or the like which form images through an electrophotographic type or electrostatic recording type process. FIG. 7 is a sectional view of a conventional developer supply container (supply opening). When a developer supply container 301 is set at a developer supplying position in the main assembly of the image forming apparatus, the shutter 302 is pushed by an unshown wedging member, so that it is moved in the direction indicated by an arrow A, by which the developer supply opening 303 is opened. When the developer supply container 301 is taken out of the main assembly of the apparatus, the shutter 302 is released from the wedging member and is moved in the opposite direction by an unshown spring member or the like, by which the developer supply opening 303 is closed. In this manner, the developer supply opening 303 opens in the set position in the image forming apparatus, and is closed by the shutter 302 when it is taken out of the apparatus for exchange or the like. By doing so, the developer is prevented from leaking out (Japanese Laid-open Patent Application 2000-347493 (U.S. Pat. No. 6,438,345), for example).

However, since the developer supply opening 303 is closed by unidirectional sliding action of the shutter 302, the developer deposited in the neighborhood of the developer supply opening 303 or the developer remaining in the developer supply container 301 is shoved to outside of the supply opening 303 by the shutter 302, and such a developer is deposited on the outer wall of the developer supply container 301 outside the developer, or the developer scatters in the image forming apparatus with the result of contamination of the developer. There is a liability that users hands are contaminated with the developer upon the exchange of the developer supply container or maintenance operation.

SUMMARY OF THE INVENTION

These and other objects, features and advantages of the present invention will become more apparent upon a consideration of the following description of the preferred embodiments of the present invention taken in conjunction with the accompanying drawings.

Accordingly, it is a principal object of the present invention to provide a developer supply container in which the developer supply container is prevented from contamination with the developer which has been shoved out by the shutter means upon resealing the discharge opening. It is another object of the present invention to provide a developer supply container in which the image forming apparatus and the developer supply container are prevented from contamination due to the scattering of the developer caused by the shutter means upon resealing of the discharge opening.

While the invention has been described with reference to the structures disclosed herein, it is not confined to the details set forth and this application is intended to cover such modifications or changes as may come within the purpose of the improvements or the scope of the following claims.

DESCRIPTION OF THE PREFERRED EMBODIMENT

The description will first be made as to the general arrangement of the image forming apparatus and then as to the developer supply container.

(Image Forming Apparatus 1)

Figure 6:
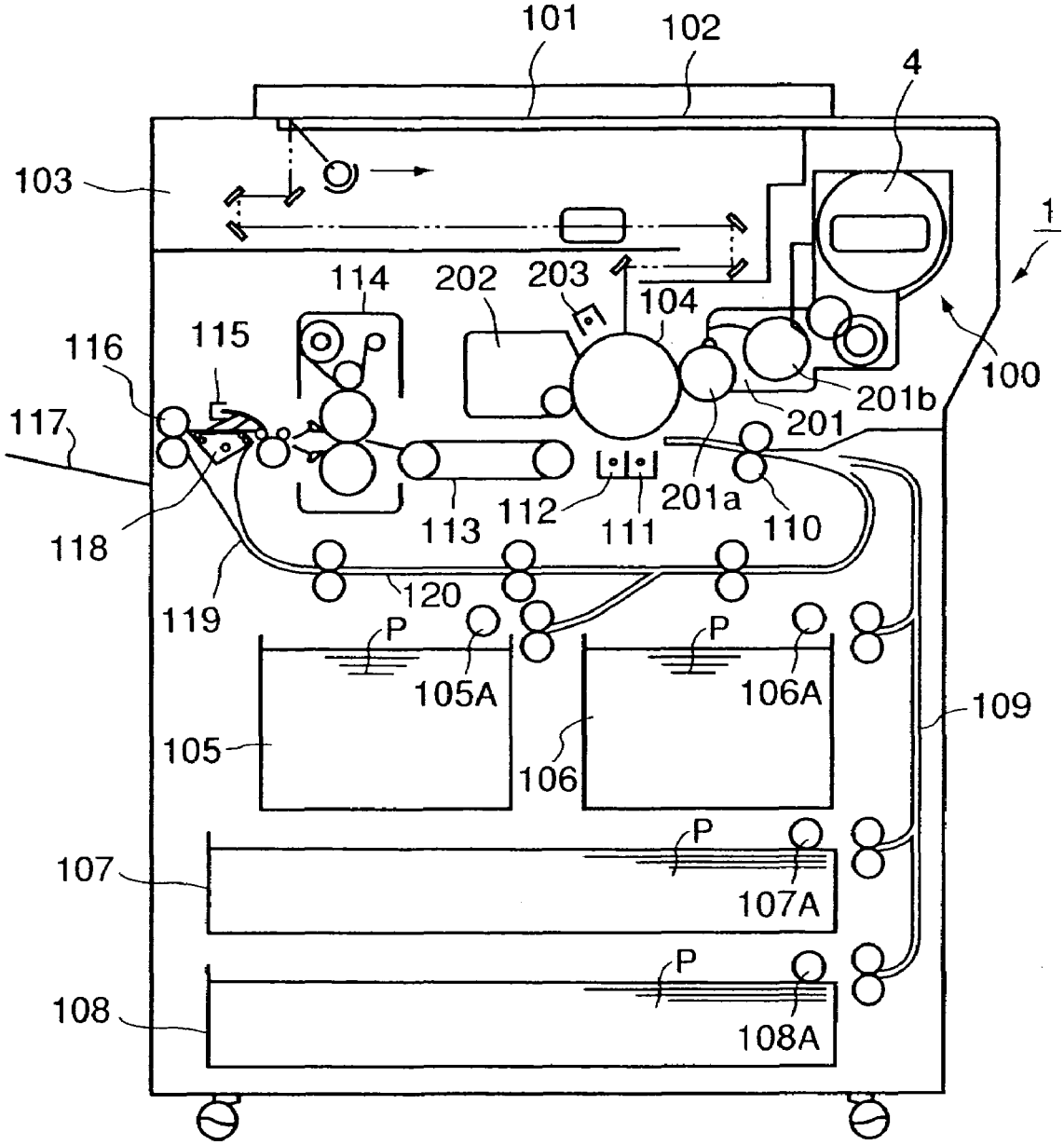
FIG. 6 is a schematic sectional view of an image forming apparatus with which the developer supply container is usable.
Figure 7:
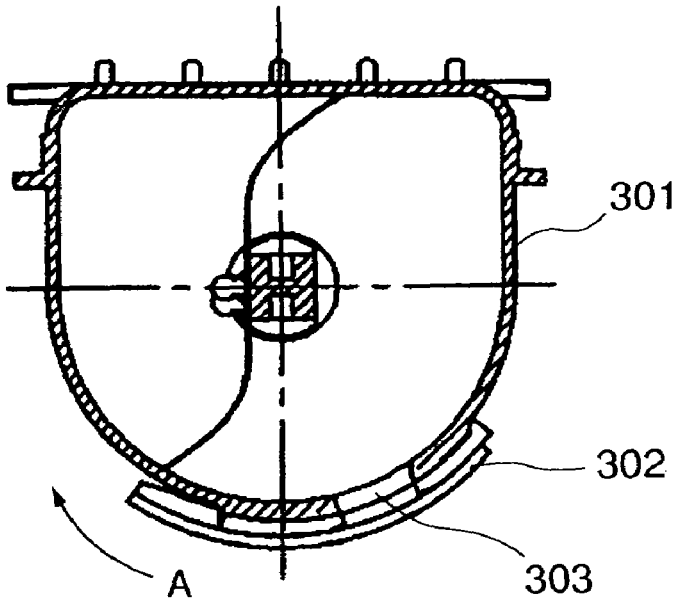
FIG. 7 is a sectional view of a conventional developer supply container (supply opening).

FIG. 6 is a schematic sectional view of an image forming apparatus with which the developer supply container is usable. The present invention is implementable with a monochromatic or full-color electrophotographic copying machine, but it is not limited to such an example. The image formation process may be an electrostatic recording type. The image forming apparatus may be in the form of a printer such as a laser beam printer or a LED printer, a facsimile machine, a word processor or a complex machine having a plurality of functions of such apparatuses.

The description will be made as to the general arrangement and the functions of the image forming apparatus 1. An original 101 is placed on an original supporting platen glass 102 by an operator. A light image of the original is formed on a photosensitive drum 104 (image bearing member) by a plurality of mirrors and a lens of an optical portion 103. By the photosensitive drum being exposed to the light image, an electrostatic image is formed on the photosensitive drum, and the electrostatic image is developed with a developer by a developing device 201. On the other hand, recording materials P, such as sheets of paper, OHP sheet as or the like, are stacked in feeding cassettes 105–108. One of the recording materials selected at an operating portion (unshown) by the operator is fed out. A roller of roller 105*a*–108A corresponding to the feeding cassette selected sheet is rotated.

The recording material P fed out all the feeding cassette is advanced to a registration roller 110 through a feeding portion 109. The registration roller 110 functions to feed the recording material P to the photosensitive drum 104 in synchronism with scanning timing of the optical portion 103 and with the rotation of the photosensitive drum 104. The recording material P receives the toner image from the photosensitive drum 104 by the function of image transferring means 111. Thereafter, the recording material P is separated from the photosensitive drum 104 by a separating means 112. The recording material P is fed to an image fixing portion 114 along a feeding portion 113. In the fixing portion 114, the toner image is fixed on the recording material P by heat and pressure.

The recording material P is fed further in different ways depending on printing modes selected from a one-sided copy, superimposed copy and the both-sided copy. In the case of the one-sided copy, the recording material P is passed through a reversion portion 115, and is discharged by discharging rollers 116 onto a tray 117. In the case of the superimposed copy, the recording material P is directed to feeding portions 119, 120 by a flapper 118 provided at the reversion portion 115. It is fed back to the registration roller 110. Then, it is supplied to the image forming station and the fixing portion 114 in the same manner, and is then discharged onto the tray 117. In the case of the duplex copy, the recording material P is partly discharged by the discharging rollers 116 temporarily through the reversion portion 115. Then, the recording material is passed through the flapper 118, and when the trailing end of the recording material P is passes through the flapper 118, said discharging roller 116 is rotated reversely. Then, the recording material P is fed into the machine. The recording material P is fed back to the registration rollers 110 through the feeding portions 119, 120.

Similarly, the recording material is supplied to the image forming station, the feeding portion and the fixing portion 114, and is finally discharged onto the tray 117.

In the image forming apparatus 1 of such a structure, there are provided around the photosensitive drum 104 a developing station 201, cleaning means 202 and primary charging means 203. The developing station 201 functions to develop the electrostatic latent image formed on the photosensitive drum 104 using toner (developer). A developer supply container 4 for supplying the corner into the developing station 201 is detachably mountable to the main assembly 124 of the apparatus. The developer may be a one-component developer comprising only toner or a two component developer comprising toner and carrier particles. The present invention is applicable to both developers.

In the developing station 201, between the photosensitive drum 104 and the developing roller 201*a*, a small gap (approx. 300 μm) is provided. In the developing operation, a thin layer of the toner is formed on the peripheral surface of the developing roller 201*a* by a developing blade 201*b*. The developing roller 201*a* is supplied with a developing bias voltage so that electrostatic latent image formed on the photosensitive drum 104 is developed.

The charging means 203 functions to electrically charge the photosensitive drum 104. The cleaning means 202 functions to remove residual toner remaining on the photosensitive drum 104. The developer is gradually supplied from a developer supply apparatus 100.

(Developer Supply Apparatus 100)

Figure 1:
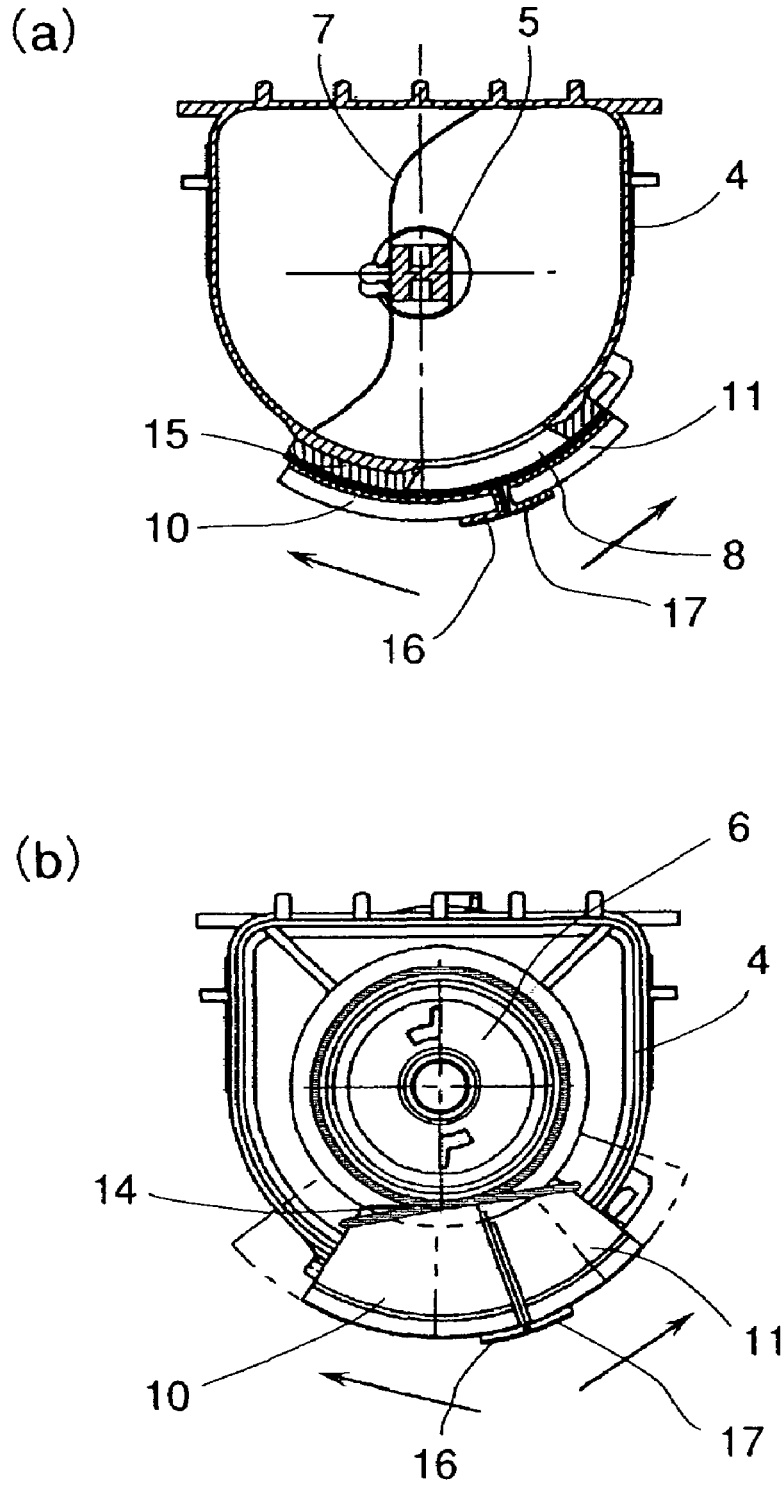
FIG. 1 is a sectional view and a side view of a developer supply container wherein a shutter is opening.
Figure 2:
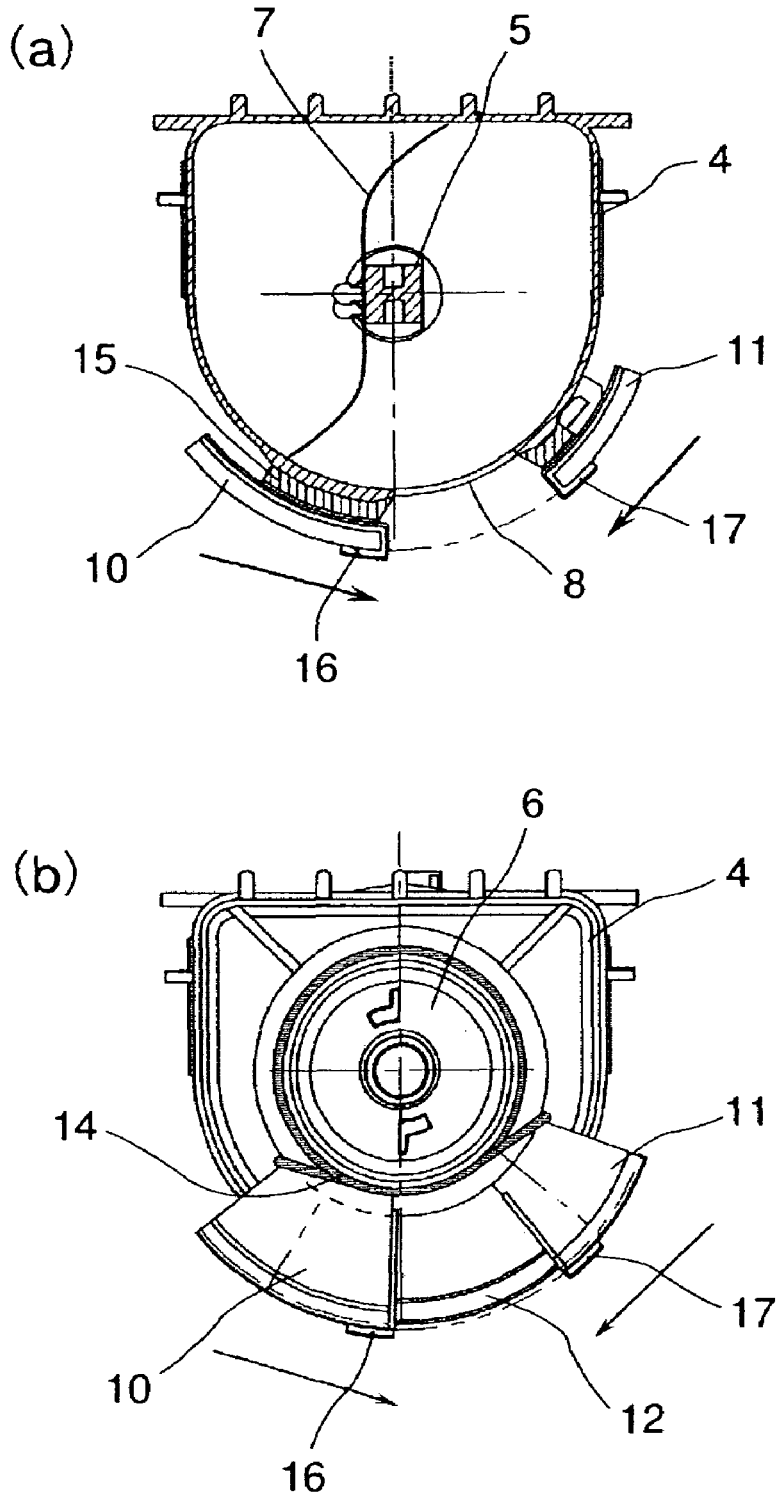
FIG. 2 is a sectional view and a side view of the developer supply container when the shutter is closing.
Figure 3:
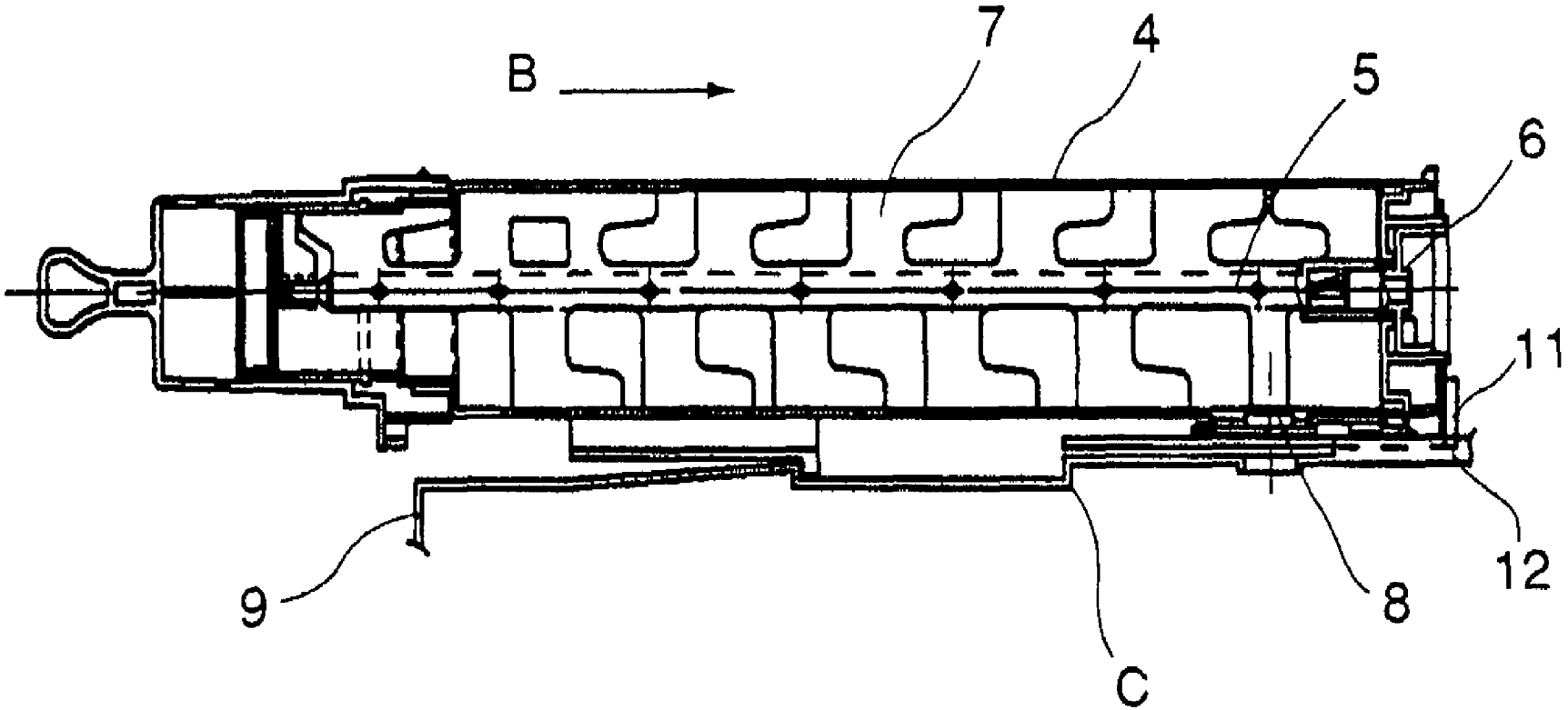
FIG. 3 is a sectional view of the developer supply apparatus as seen from the front side.
Figure 4:
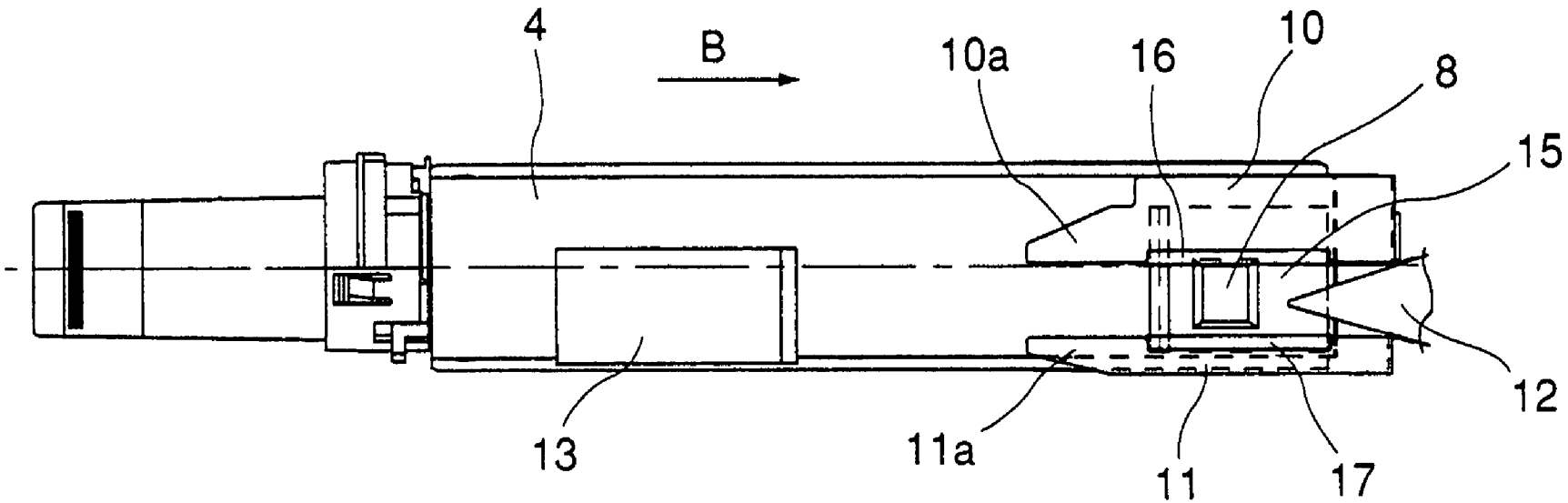
FIG. 4 is a front view in which the shutter is expanded by a wedging member.
Figure 5:
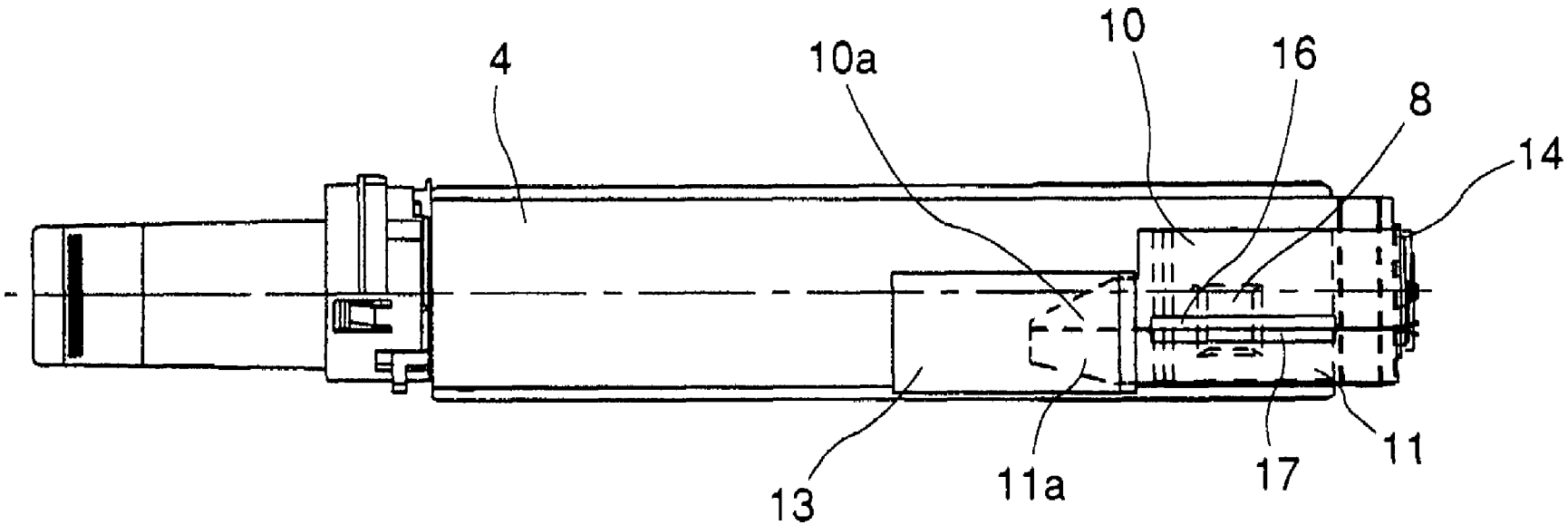
FIG. 5 is a front view of a developer supply container wherein the sealing member seals the shutter.

Referring to FIGS. 1–5, the detailed description will be made as to the developer supply apparatus 100 which functions to supply the developer into the developing station 201 of the main assembly of apparatus. FIG. 1 is a sectional view and a side view of a developer supply container wherein a shutter is opening. FIG. 2 is a sectional view and a side view of the developer supply container when the shutter is closing. FIG. 3 is a sectional view of the developer supply apparatus as seen from the front side. FIG. 4 is a front view in which the shutter is opened by a wedging member (guiding member). FIG. 5 is a front view of a developer supply container wherein the sealing member seals the shutter.

As shown in FIGS. 2 and 3, the developer supply container 4 comprises a container body for accommodating the developer (toner or a mixture of the toner and carrier), a rotation shaft 5, a coupling member 6 for driving connection with the main assembly of the apparatus to receive a driving force and for transmitting the driving force to the rotation shaft 5, stirring sheets 7 functioning to stir the developer in the container by the rotation of the rotation shaft 5, a developer supply opening 8 (discharge opening) for supplying the developer into the developing station 201, shutter means including a first shutter member 10 and a second shutter member 11, disposed at the periphery of the body of the container, for opening and closing the developer supply opening 8. A sealing material 15 is provided around the developer supply opening 8 to prevent the toner leakage and is slidable relative to the shutters 10, 11 on the container body side. The sealing material may be provided on the inner side of the shutters 10, 11 in place of the container body. The shutters 10, 11 of this embodiment is movable along the peripheral surface of the developer supply container and have curvatures along it. The sliding directions of the shutters 10, 11 are not limited to the circumferential direction, but may be linear along the longitudinal direction of the container body. The sealing materials 16, 17 are provided on the shutter 10, 11 to seal a gap between the abutting surfaces of the shutters 10, 11. The material of the sealing material may be made of resin material or rubber, and the composition thereof are not particularly limited. An elastic member or a foam member suffices if the sealing function can be performed.

The developer supply container 4 contains the developer, and when the center portion rotation shaft 5 is set in place relative to the coupling member 6 in the image forming apparatus, the rotation shaft 5 receives a rotating force from an unshown rotation transmitting mechanism so that stirring sheets 7 mounted on the rotation shaft 5 are rotated, by which the developer is gradually supplied into the developing station 201 through the developer supply opening 8. The shutters 10, 11 of the developer supply container 4 are urged in directions of abutting each other to close the developer supply opening 8 with the aid of sealing materials 16, 17, by spring 14 (urging means). The spring may be replaced with another known means which is capable of performing the similar function. In this example, the shutters 10, 11 are abutted to each other to close the developer supply opening 8 at a position facing to the developer supply opening 8. With this structure, the developer shoved by the closing operation of the shutters 10, 11 fall down into a developer receiving port provided in the main assembly of the apparatus, so that contamination of the outer surface of the container with the developer and/or the outer surface of the main assembly of the apparatus as with the conventional structure can be avoided.

Referring to FIG. 1 to FIG. 5, the operation of the developer supply container 4 will be described. The developer supply container 4 is inserted into the main assembly of the apparatus. More particularly, the container is inserted in the direction indicated by an arrow B in FIGS. 3 and 4. Then, a free end of an engaging or guiding member 12 (wedge) functioning as an inducing means disposed above the developing station 201 in the main assembly of the apparatus is contacted by engaging portions of the shutters 10, 11 which are urged toward each other. With the continued insertion of the developer supply container 4 into the main assembly of the apparatus, the developer supply container 4 is set in place. In this state, the shutter 10 and the shutter 11 are spaced apart from each other by the wedging member 12, and simultaneously, so that sealing members 16, 17 are spaced from each other, by which the developer supply opening opening operation is completed. In this state, the rotation shaft 5 is rotated by the driving force received from the main assembly of the apparatus, and the stirring sheet 7 is driven thereby. The developer stirred by the stirring sheet 7 are discharged through the developer supply opening 8, and is received by the developer receiving port provided in the apparatus and is supplied into the developing station 201. With this structure, as described hereinbefore, the shutters 10, 11 can be actuated to open and close the opening in interrelation with the setting and removing operations of the developer supply container relative to the main assembly of the image forming apparatus, and therefore, the usability is high.

When the developer in the developer supply container 4 is used up, or when a maintenance operation is required, the developer supply container 4 is pulled out in the direction opposite to the direction indicated by the arrow B, by which the urging of the shutters 10, 11 by the wedging member 12 in the opening directions is gradually reduced until the shutters 10, 11 are disengaged from the engaging member 12. When the exchange or removal of the developer supply container 4 is completed, the shutters 10, 11 kept urged by the spring 14 return to the original positions where the developer supply opening 8 is resealed by the sealing material 15, the shutters 10, 11 and the sealing materials 16, 17. The length of the developer receiving port of the main assembly measured in the direction B is properly set such that developer deposition on the edge of the developer supply opening and the like (the edge of the sealing material 15 and the like) falls into the developer receiving port until the closing operation of the shutters 10, 11 is completed. A part of the developer deposition on the edge of the developer supply opening and the like returns into the container with the closing operation of the shutters 10, 11.

As shown in FIGS. 4 and 5, a stopping member (locking member) 13 is disposed for sliding motion in a longitudinal direction of the developer supply container 4 (substantially parallel with the container mounting direction). The shutters 10, 11 are provided with engaging portions (locking portions) 10*a*, 11*a* engageable with the stopping member 13. Therefore, when the developer supply container 4 is mounted to the main assembly of the apparatus, the stopping member 13 is disengaged from the engaging portions 10*a*, 11*a* of the shutters 10, 11 by the projection C (releasing member) disposed in the developing station 201 provided in the main assembly of the apparatus shown in FIG. 3, thus permitting the opening movements of the shutters 10, 11. By this, the shutter 10 and the shutter 11, and therefore, the sealing materials 16, 17 thereon are spaced apart from each other by the wedging member 12 wedging into therebetween.

When the developer supply container 4 is taken out of the main assembly of the apparatus, the engaging portions 10*a*, 11*a* of the shutters 10, 11 are locked by the stopping member 13 so that shutters 10, 11 are prevented from opening.

When the developer supply container 4 is removed from the main assembly of the apparatus, the shutters 10, 11, the shutter constituted by a plurality of shutter members 10 and 11 (sealing members 16, 17) is closed so as to move the developer substantially toward center portion of the developer supply opening 8, and therefore, the developer does not contaminate the outer wall of the developer supply container 4 other than the center portion of the developer supply opening 8 or a neighborhood of the developing station 201 of the main assembly of the image forming apparatus. By the provision of the stopping member 13, the shutters 10, 11 (sealing materials 16, 17) can be assuredly maintained in the closed state except when the container is set in place in the apparatus, and therefore, the contamination of the developing station 201 is further prevented.

(Another Embodiment)

Figure 8:
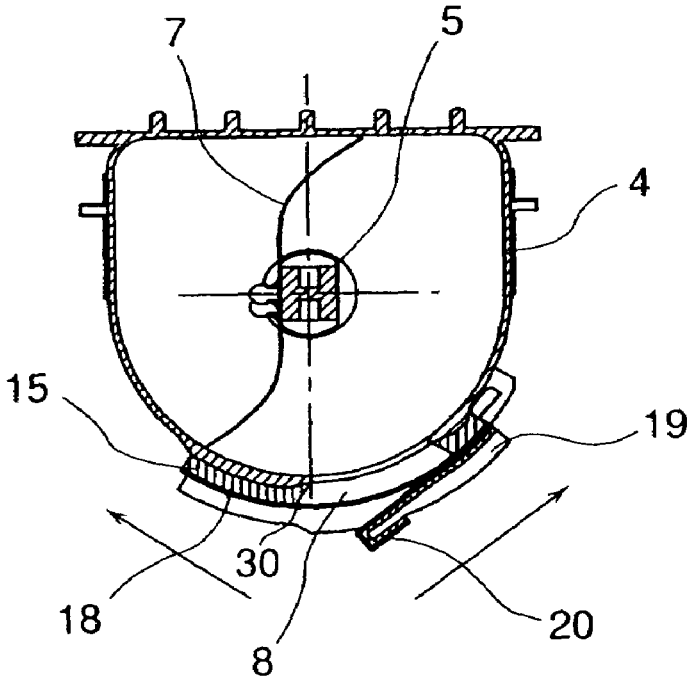
FIG. 8 is a sectional view of a developer supply container according to another embodiment wherein the shutter members are overlapped, in the shown state, the shutter is opening.
Figure 9:
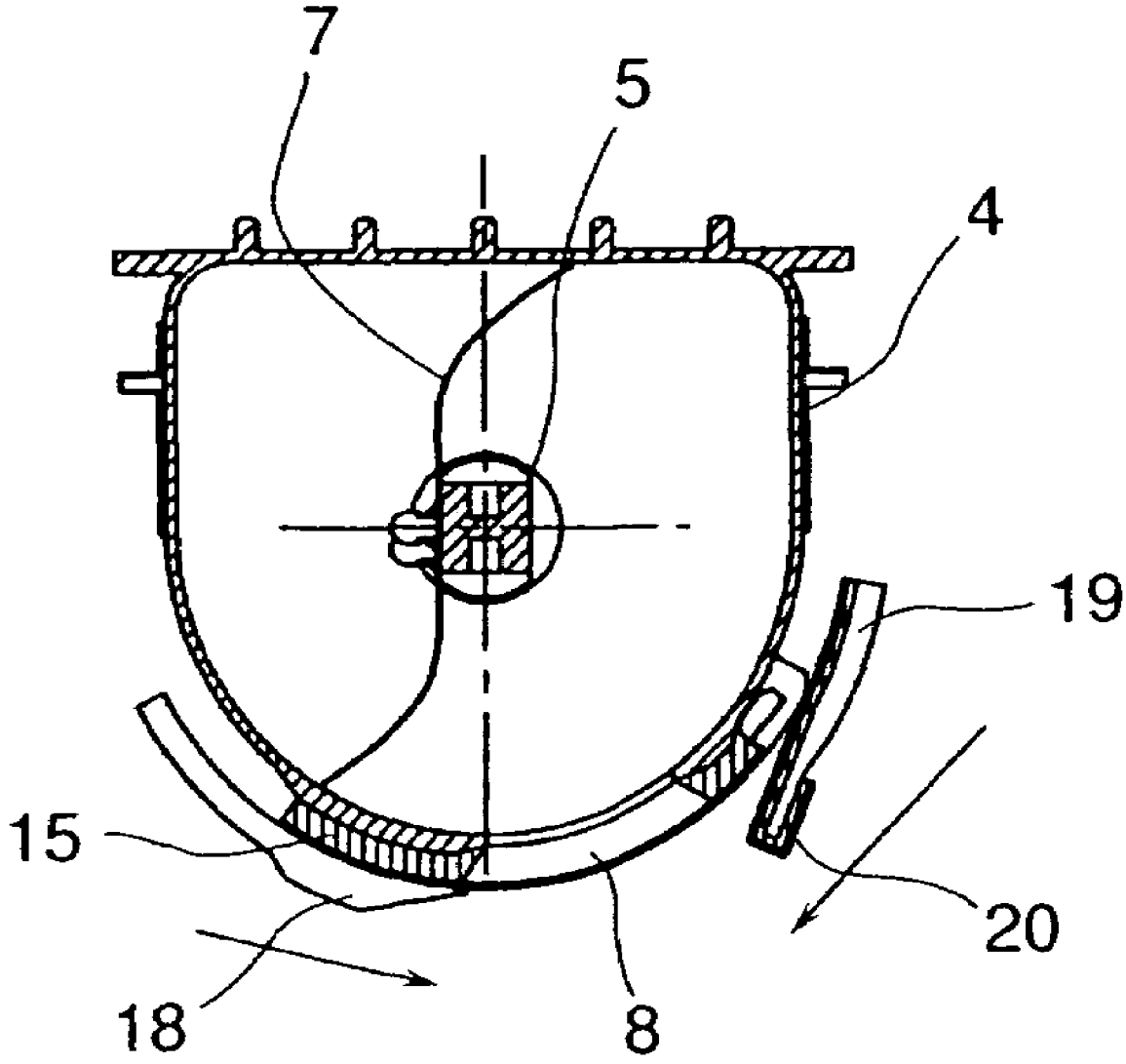
FIG. 9 is a sectional view of the developer supply container in the another embodiment, wherein the shutter is closing.

In the foregoing embodiment, end surfaces of the two shutter members are abutted to each other to close the developer supply opening. This is not limiting in the present invention, and as shown in FIGS. 8, 9, the developer supply opening may be closed by parts of the shutter members overlapping on each other. Also in this embodiment, a sealing material 20 is used. A shutter 18 and a shutter 19 are overlapped with each other with the sealing material 20 therebetween to close the developer supply opening 8. Namely, the shutters are press-contacted overlappingly with each other with the sealing material disposed therebetween to reseal the developer supply opening. With this structure, the sealing level of the developer supply opening is further enhanced, thus accomplishing a highly reliable developer supply container. When the developer supply opening 8 is closed, the seal portion 30 between the shutters is located at a position facing to the developer supply opening 8, so that contamination with the developer shoved out by the shutters can be effectively prevented similarly to the foregoing embodiment.

In this embodiment, engaging portions of the shutter members 18 and 19 are engaged by a free end portion of the triangular wedging or engaging member 12 upon unsealing. In order to accomplish easy engagement between the free end portion and the engaging portions of the wedging member 12, the shutter members are not overlapped at the engaging portions. Therefore, the engaging portions are disposed at a position away from the developer supply opening in the mounting direction (direction B in FIG. 4.

The other structures including the opening and closing operations are similar to those of the foregoing embodiment, and therefore, the detailed descriptions thereof are omitted for simplicity.

As described in the foregoing, according to the embodiments of the present invention, the contamination of the outer wall of the developer supply container and/or the neighborhood of the developer receiving port (developing device) of the image forming apparatus with the developer shoved out by the shutter members upon resealing the developer supply opening can be prevented. Accordingly, the operators hands or the like can be prevented from contamination when the developer supply container is exchanged, or when the maintenance operation for the neighborhood of the developer receiving port is carried out.

While the invention has been described with reference to the structures disclosed herein, it is not confined to the details set forth and this application is intended to cover such modifications or changes as may come within the purpose of the improvements or the scope of the following claims.

What is claimed is:

1. A developer supply container detachably mountable to an image forming apparatus, comprising:

a container body for containing a developer;

a discharge opening for permitting discharge of the developer from said container body; and shutter means for unsealing and sealing said discharge opening, wherein said shutter means includes a first shutter member and a second shutter member, which are engageable with each other to form a resealable shutting portion at a position facing to said discharge opening.

2. A container according to claim 1, wherein said first and second shutter members are overlapped with each other at the position facing to said discharge opening when they reseal said discharge opening at the shutting portion.

3. A container according to claim 1, wherein said first and second shutter members include respective sealing members at positions where said first and second shutter members are contacted to each other.

4. A container according to claim 1, further comprising urging means for urging said first and second shutter members toward each other.

5. A container according to claim 1, wherein said first shutter member and said second shutter member abut to each other the position facing to said discharging opening when they reseal said discharge opening at the shutting portion.

6. A developer supply container detachably mountable to an image forming apparatus, comprising:

a container body for containing a developer;

a developer discharging opening, provided in a peripheral surface of said container body, for permitting discharge of the developer in said container body toward a developer receiving opening of the image forming apparatus; and shutter means for unsealing and sealing said developer discharging opening, wherein said shutter means includes a first shutter member and a second shutter member, which are engageable with each other to form a resealable shutting portion at a position facing to the developer receiving opening.

7. A container according to claim 6, wherein said first and second shutter members are overlapped with each other at the position facing to the developer receiving opening when they reseal said developer discharging opening.

8. A container according to claim 6, wherein said first and second shutter members include respective sealing members at portions where said first and second shutter members are contacted to each other.

9. A container according to claim 6, further comprising urging means for urging said first and second shutter members toward each other.

10. A container according to claim 6, wherein said first shutter member and said second shutter member abut to each other at the position facing to the developer receiving opening when they reseal said developer discharging opening at the shutting portion.

11. A developer supply container detachably mountable to an image forming apparatus, comprising:

a container body for containing a developer, said container body being provided with a developer discharging opening for permitting discharge of the developer downwardly toward a developer receiving opening of the image forming apparatus; and a first shutter and a second shutter cooperative with each other to seal and unseal said developer discharging opening.

12. A developer supply container according to claim 11, wherein when said developer discharging opening is resealed, said first shutter and said second shutter are abutted to each other at a position opposing to said developer discharging opening.

13. A developer supply container according to claim 11, wherein when said developer discharging opening is resealed, said first shutter and said second shutter are overlapped with each other at a position opposing to said developer discharging opening.

14. A developer supply container according to claim 11, wherein when said developer discharging opening is resealed, said first shutter and said second shutter are abutted to each other at a position opposing to the developer receiving opening.

15. A developer supply container according to claim 11, wherein when said developer discharging opening is resealed, said first shutter and to said second shutter are overlapped with each other at a position opposing to the developer receiving opening.

* * * * *

UNITED STATES PATENT AND TRADEMARK OFFICE

CERTIFICATE OF CORRECTION

PATENT NO. : 7,111,654 B2
APPLICATION NO. : 11/203117
DATED : September 26, 2006
INVENTOR(S) : Masafumi Takagi It is certified that error appears in the above-identified patent and that said Letters Patent is hereby corrected as shown below:

COVER PAGE AT ITEM (57) Abstract:
Line 4, "body; shutter" should read --body; and shutter--.

COLUMN 2:
Line 32, "the" (first occurrence) should be deleted.

COLUMN 3:
Line 1, "out all" should read --out by all--; and "cassette" should read --cassettes--.
Line 30, "is" should be deleted.
Line 45, "corner" should read --toner--.

COLUMN 4:
Line 39, "are" should read --is--.

COLUMN 5:
Line 18, "are" should read --is--.

COLUMN 6:
Line 7, "toward center" should read --toward a center--.
Line 48, "Fig. 4." should read --Fig. 4).--.
Line 60, "operators" should read --operator's--.

COLUMN 8:
Line 42, "to" should be deleted.

Signed and Sealed this

Third Day of April, 2007

JON W. DUDAS
*Director of the United States Patent and Trademark Office*